United States Patent [19]

Courtney

[11] Patent Number: 4,981,134

[45] Date of Patent: Jan. 1, 1991

[54] FILTERING FACE MASK WITH INHALATION/EXHALATION CHECK VALVES

[76] Inventor: Darryl W. Courtney, 3814 Columbia Pike, #11, Arlington, Va. 22204

[21] Appl. No.: 465,493

[22] Filed: Jan. 16, 1990

[51] Int. Cl.[5] ..... A62B 18/02; A62B 18/10

[52] U.S. Cl. ..... 128/207.12; 128/206.15

[58] Field of Search ..... 128/205.27, 205.28, 128/205.29, 206.12, 206.15, 206.21, 206.24, 206.29, 207.12

[56] References Cited

U.S. PATENT DOCUMENTS

| | | | |
|---|---|---|---|
| 216,171 | 6/1879 | Foster | 128/206.15 |
| 2,067,026 | 1/1937 | Schwartz | 128/206.12 |
| 2,382,592 | 8/1945 | Whipple | 128/206.12 |
| 2,640,481 | 6/1953 | Conley | 128/206.15 |
| 2,652,828 | 9/1953 | Matheson | 128/206.15 |
| 2,744,525 | 5/1956 | Whipple | 128/206.15 |
| 2,888,012 | 5/1959 | Larson | 128/207.12 |
| 2,895,472 | 7/1959 | Matheson | 128/206.15 |
| 2,910,979 | 11/1959 | Shanty et al. | 128/206.12 |
| 2,964,038 | 12/1960 | Silverman | 128/206.15 |
| 2,999,498 | 9/1961 | Matheson | 128/206.15 |
| 3,029,812 | 4/1962 | Matheson | 128/206.15 |
| 3,118,445 | 1/1964 | Norman | 128/206.17 |
| 3,276,445 | 10/1966 | Langdon | 128/206.15 |
| 4,630,604 | 12/1986 | Montesi | 128/206.15 |
| 4,850,346 | 7/1989 | Michel et al. | 128/206.15 |
| 4,886,058 | 12/1989 | Brostrom et al. | 128/206.12 |

*Primary Examiner*—Clifford D. Crowder
*Assistant Examiner*—Kimberly L. Asher
*Attorney, Agent, or Firm*—Walter F. Wessendorf, Jr.

[57] ABSTRACT

A respirator comprising an assembly of an outer housing member and an inner housing member which sandwich therebetween a filter and valve assembly that functions to allow the use to inspire purified and filtered outside air.

2 Claims, 2 Drawing Sheets

Fig.2
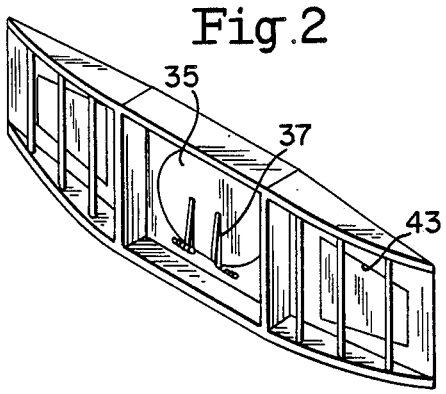
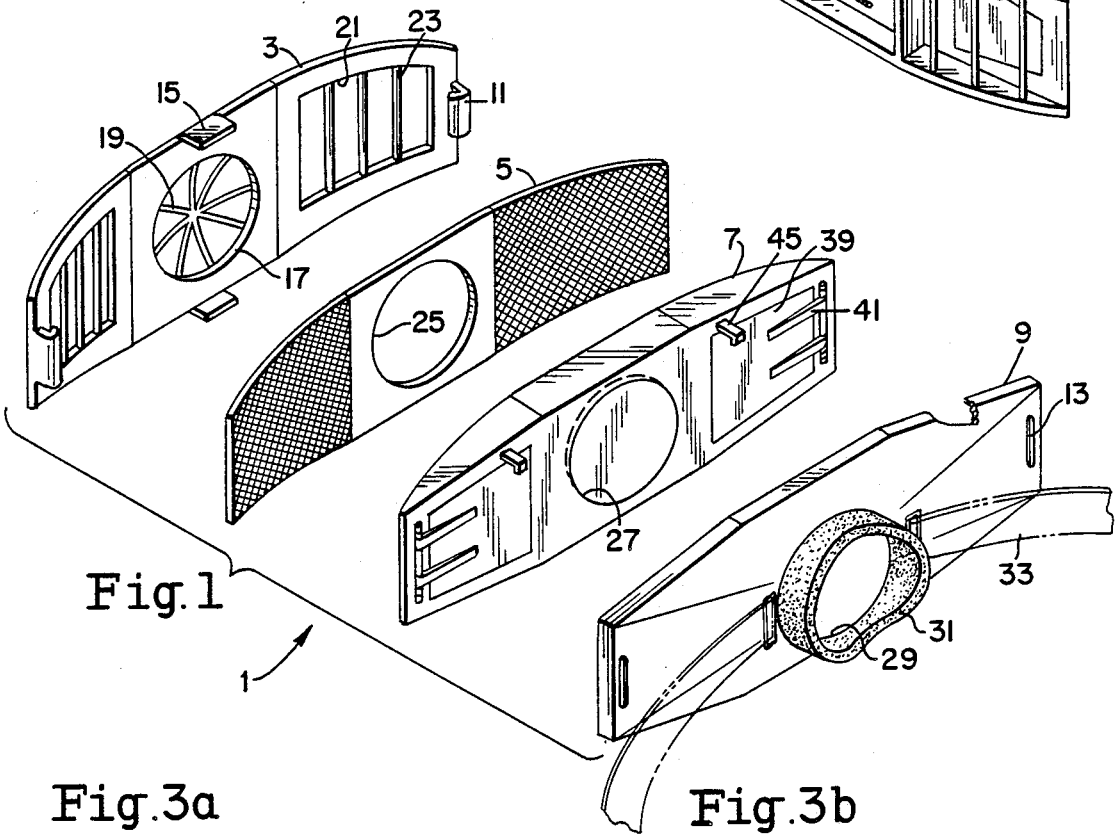
Fig.1
Fig.3a
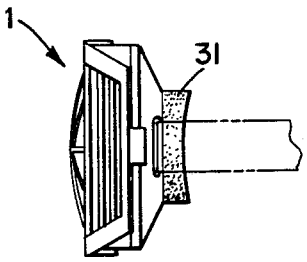
Fig.3b
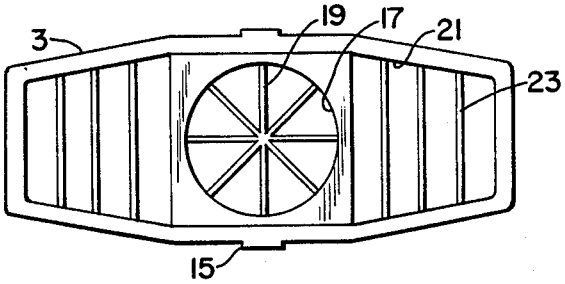
Fig.4
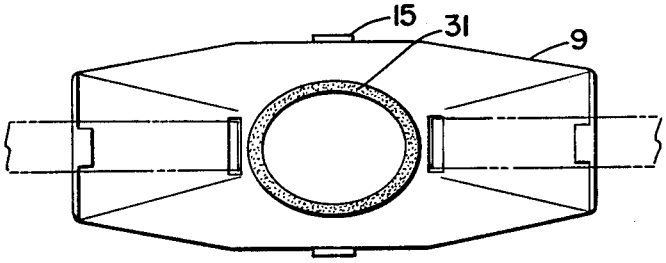

FILTERING FACE MASK WITH INHALATION/EXHALATION CHECK VALVES

BACKGROUND OF THE INVENTION

1. Technical Field

This invention relates to a respirator to allow a user to inspire filtered outside air.

2. Background

The problem in the art to which this invention apertains is the need for a respirator that can be easily disassembled, having an outer housing member and an inner housing member which sandwich therebetween, in assembly a filter and valve assembly and which functions to allow the user to inspire purified and filtered outside air.

SUMMARY OF THE INVENTION

This invention contributes to the solution of the discussed problem by providing a respirator having ar outer housing member and an inner housing member that sandwich therebetween, in assembly, a filter and valve assembly which function to allow the user to breathe in purified and filtered outside air.

BRIEF DESCRIPTION OF THE DRAWINGS

This object and other objects of the invention should be discerned and appreciated from the detailed description of the preferred embodiment taken in conjunction with the drawings, wherein like reference numerals refer to similar parts throughout the several views, in which:

FIG. 1 is an exploded assembly view, in perspective, of the respirator;

FIG. 2 is a perspective view of the valve assembly for the respirator;

FIG. 3*a* is a side elevational view of the assembled respirator;

FIG. 3*b* is a front elevational view of the respirator;

FIG. 4 is a rear elevational view of the respirator;

DETAILED DESCRIPTION OF THE PREFERRED EMBODIMENT

Figure 5A:
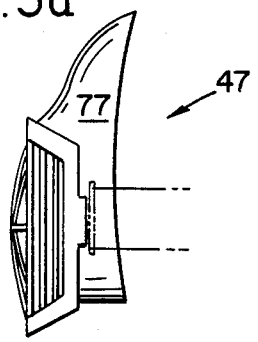
FIG. 5*a* is a side elevational view of a modification of the respirator shown in FIGS. 1, 2, 3*a*, 3*b* and 4.
Figure 5B:
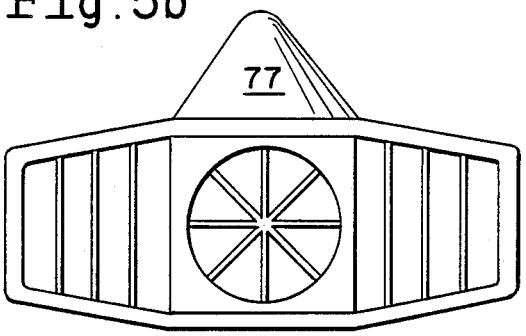
FIG. 5*b* is a front elevational view of such modification.
Figure 6:
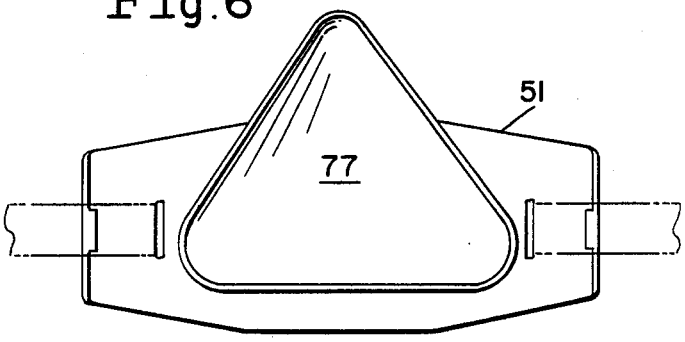
FIG. 6 is a rear elevational view of such modification.
Figure 7:
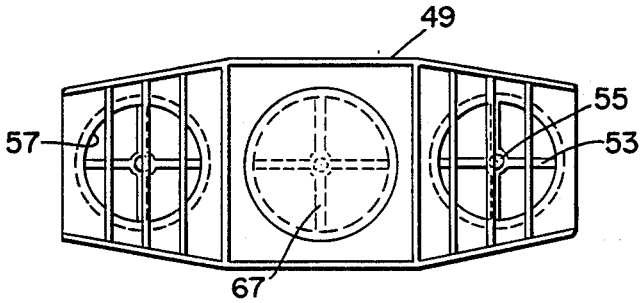
FIG. 7 is a front elevational view of the valve assembly for such modification.
Figure 8A:
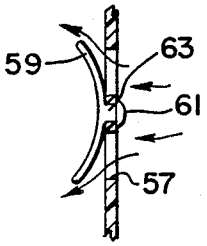
FIG. 8*a* is a sectional view of one of the valve-controlled inspiration ports of the valve assembly for such modification.
Figure 8B:
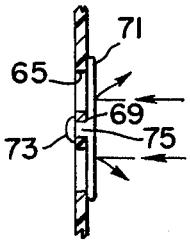
FIG. 8*b* is a sectional view of the valve-controlled expiration port of the valve assembly for such modification.

In FIG. 1 of the drawings, reference numeral 1 generally refers to the respirator comprising an outer housing member 3, a flexible filter 5, a valve assembly 7 and an inner housing member 9. The outer housing member 3 valve assembly 7 and inner housing member 9 are made of suitable plastic material. The outer housing member 3 has, on its lateral sides, rewardly projecting snap fits 11 of living plastic which are engageable with correspondingly aligned raised projections 13 on the rear surface of the inner housing member 9 to allow disassembly of the respirator as a unit into its component parts. The outer housing member 3 and inner housing member 9 sandwich therebetween the filter 5 and valve assembly 7. Guide elements 15 rearwardly extending from the top and bottom middle portions of the outer housing member 3, together with the snap fits 11 engaging their respective raised projections 13, effect alignment, in assembly, of the outer housing member 3, filter 5, valve assembly 7 and inner housing member 9 with one another. The outer housing member 3 has a central circular opening 17, protected by a grille-like spider of radial elements 19, and lateral trapezoidal-like openings 21, protected by a grille of vertical elements 23. Filter 5 has a central circular opening 25, valve assembly 7 has a central circular opening or expiration port 27 and the inner housing member 9 has a central opening 29. In the assembly of the respirator 1, the central openings 17, 25, 27 and 29 are aligned with one another, A mouth-piece seal 31, of suitable foamrubber material, is suitably fixed to and projects rearwardly from the inner housing member 9 An elastic strap 33, whose terminal ends are attached to the rear portion of the inner housing member 9, allows the respirator 1 to be comfortably mounted and worn around the head of the user and with the mouth-piece seal 31 mounted around the user's mouth. A central circular flapper valve 35, spring-biased into valve seating and closing relationship by leaf-springs 37, seats valve 35 against the central circular opening or expiration port 27 of the valve assembly 7. Lateral flapper valves 39 of trapezoidal-like configuration, spring-biased into valve seating and closing relationship by leaf springs 41, seat valves 39 against correspondingly aligned openings or inspiration ports 43 of corresponding trapezoidal-like configuration in the valve assembly 7. L-shaped ears 45, rearwardly projecting from the valve assembly 7, function as limit stops to limit the extent of rearward movement and opening of the flapper valves 39 relative to their inspiration ports 43. In operative use of the respirator 1, the user, in his inspiration cycle, breathes in through his mouth, sealed by the mouth-piece seal 31, thereby creating negative pressure interiorly and causing the lateral flapper valves 39 to unseat and open with outside air being drawn through the lateral openings 21, filter 5, opened flapper valves 39, interior concave surface of the inner housing member 9 establiship communication with central opening 29 and thereby through opening 29. Upon cessation of the user's inspiration cycle, the restoring force of the leaf-springs 41 will cause seating of the lateral flapper valves 39. When the user, in his expiration cycle, exhales, the resulting force components from such exhalation of breath will be directed against and cause the flapper valves 39 to firmly seat against their inspiration ports 43; and, concomitantly, such force components contemporaneously will cause the central flapper valve or exhaust valve 35 to unseat and open with such exhaled breath flowing through openings 27, 25 and 17 to atmosphere.

In FIG. 5*a* of the drawings, reference numeral 47 generally refers to a modification of the respirator 1 previously described. Respirator 47 differs structurally from respirator 1 in its valve assembly 49 and inner housing member 51. Valve assembly 49 has spiders of intersecting elements 53 defining apertures 55. The lateral openings, inspiration ports or intake ports 57 are circular and against which circular flapper valves or intake valves 59 seat. The flapper valves 59 are of suitable rubber-like material and have tranversely projecting nubs 61 with shouldered portions 63 complemental to apertures 55. Upon being appropriately disposed through their respective apertures 55, the nubs 61 resume their normal shapes to retain the flapper valves 59 as so disposed. The central circular opening, expiration port or exhaust port 65 of the valve assembly 49 has a spider of intersecting elements 67 defining an aperture 69. A circular flapper valve, expiration valve or exhaust valve 71, of suitable rubber material or the like, seats against the central circular opening 65 of the valve assembly 49. Valve 71 has a transversely projecting nub 73 with a shouldered portion 75 complemental to aperture 69. Upon being appropriately disposed through aperture 69, nub 73 resumes its normal shape to retain flapper valve 71 as so disposed. In place of the mouthpiece seal 31, the inner housing member 51 has a combined nose-and-mouth-piece seal 77, of suitable foam rubber material, fixed to and projecting rearwardly from inner housing member 51 and which seal, in operative use, is mounted around the user's nose and mouth. Respirator 47 employs flexible filter that is of the same structure, configuration and function a filter 5. In operative use of the respirator 47, the user's inspiration cycle similarly creates interior negative pressure thereby causing the intake valves 59 to unseat and open with outside air being drawn through the intake ports 57 of the valve assembly 49 and likewise causing the exhaust valve 71 to firmly seat against its exhaust port 65 of the valve assembly 49. Similarly, the user's expiration cycle will cause the intake valves 59 to firmly seat against and close the intake ports 57 and likewise cause the exhaust valve 71 to unseat and open with the user's expired breath flowing through the exhaust port 65.

Whereas, respirator 1 restricts the user to inspiration and expiratrion to be effected solely via the user's mouth, the respirator 47 allows the user to effect inspiration and expiration via six modes, to wit: (1) inspiration through his nose followed by expiration through his nose or expiration through his mouth; (2) inspiration through his mouth followed by expiration through his mouth or expiration through his nose; (3) inspiration through both his nose and mouth followed by expiration through his nose or expiration through his mouth; (4) inspiration through his nose followed by expiration through both his nose and mouth; (5) inspiration through his mouth followed by expiration through both his nose and mouth; and (6) inspiration through both his nose and mouth followed by expiration through both his nose and mouth. Such described phenomena of respirator 47 allows the user to accommodate particular problems such as the problem of a deviated septum, the problem a user may have in opening his mouth, the problem a user may have breathing in or expiring through his nose, the problem a user may have in breathing in through his mouth or expiring through his mouth.

The flexible filter 5 is made of suitable material such as the flexible and thin ($\frac{1}{8}$") FLITRETE BRAND G FILTER manufactured by 3M Company which fillers out particulate matter whose particle size is 0.3 microns or greater and purifies inspired outside air by filtering out airborne pollutants, pollen, dust, smoke.

I claim:

1. A respirator for use by a human user in his inspiration and expiration cycles, said respirator comprising:

a separate outer housing member, a separate flexible filter, a separate valve assembly and a separate inner housing member, having boundary configurations complemental with one another, said outer housing member and said inner housing member sandwiching therebetween said filter and said valve assembly, said outer housing member and said inner housing member having cooperating snap fit means, operative for removably securing together as an assembled respirator unit, said outer housing member and said inner housing member with said filter and said valve assembly interposed therebetween, said inner housing member having interior and exterior surfaces, said exterior surface of said inner housing member carrying sealing means rearwardly projecting therefrom for interfacing around the mouth of the user and for effecting sealing relationship around the mouth of the user, said interior surface of said inner housing member being of concave configuration and defining an air chamber, said inner housing member having one central opening means for establishing communication of said sealing means with said air chamber, said valve assembly, said flexible filter and said outer housing member each having one central opening means in direct rectilinear alignment with one another and with said one central opening means of said inner housing member for establishing communication of said air chamber with the atmosphere, said valve assembly having one one-way exhaust valve means in seating relationship with said one central opening means of said valve assembly for establishing such communication of said air chamber with the atmosphere upon said one exhaust valve means opening in response to positive pressure in said air chamber resulting from the user's expiration cycle, said valve assembly and said outer housing member each having two separate lateral opening means, in direct rectilinear alignment with one another, for establishing communication of said air chamber with the atmosphere, said central opening means of said valve assembly, said flexible filter and said outer housing member defining imaginary bisecting mid lines, said lateral opening means of said valve assembly and said outer housing member defining imaginary bisecting mid lines, and said imaginary bisecting mid lines of said central opening means and said lateral opening means being coplanar with and occupying the same imaginary horizontal plane, said valve assembly having two separate lateral intake valve means in seating relationship with said lateral opening means of said valve assembly for establishing communication of said air chamber with the atmosphere upon said intake valve means opening in response to negative pressure in said air chamber resulting from the user's inspiration cycle, and said filter being constructed of material means for purifying inspired outside air by filtering out airborne pollutants, pollen, dust and smoke.

2. A respirator for use by a human user in his inspiration and expiration cycles, said respirator comprising:

a separate outer housing member, a separate flexible filter, a separate valve assembly and a separate inner housing member, having boundary configurations complemental with one another, said outer housing member and said inner housing member sandwiching therebetween said filter and said valve assembly, said outer housing member and said inner housing member having cooperating snap fit means, operative for removably securing together as an assembled respirator unit, said outer housing member and said inner housing member with said filter and said valve assembly interposed therebetween, said inner housing member having interior and exterior surfaces, said inner housing member's exterior surface carrying sealing means rearwardly projecting therefrom for interfacing around the nose and mouth of the user and for effecting sealing relationship around said nose and mouth of the user, said interior surface of said inner housing member being of concave configuration and defining an air chamber, said inner housing member having one central opening means for establishing communication of said sealing means with said air chamber, said valve assembly, said flexible filter and said outer housing member each having one central opening means in direct rectilinear alignment with one another and with said one central opening means of said inner housing member for establishing communication of said air chamber with the atmosphere, said valve assembly having one one-way exhaust valve means in seating relationship with said one central opening means of said valve assembly for establishing such communication of said air chamber with the atmosphere upon said one exhaust valve means opening in response to positive pressure in said air chamber resulting from the user's expiration cycle, said valve assembly and said outer housing member each having two separate lateral opening means, in direct rectilinear alignment with one another, for establishing communication of said air chamber with the atmosphere, said central opening means of said valve assembly, said flexible filter and said outer housing member defining imaginary bisecting mid lines, said lateral opening means of said valve assembly and said outer housing member defining imaginary bisecting mid lines, and said imaginary bisecting mid lines of said central opening means and said lateral opening means being coplanar with and occupying the same imaginary horizontal plane, said valve assembly having two separate lateral intake valve means in seating relationship with said lateral opening means of said valve assembly for establishing communication of said air chamber with the atmosphere upon said intake valve means opening in response to negative pressure in said air chamber resulting from said user's inspiration cycle, and said filter being constructed of material means for purifying inspired outside air by filtering out airborne pollutants, pollen, dust and smoke.

* * * * *